US011974640B2

(12) United States Patent
Zhang et al.

(10) Patent No.: US 11,974,640 B2
(45) Date of Patent: May 7, 2024

(54) WRISTBAND AND WRIST WEARABLE DEVICE

(71) Applicant: GOERTEK INC., Shandong (CN)

(72) Inventors: Jianning Zhang, Shandong (CN); Qingru Shao, Shandong (CN); Huaying Feng, Shandong (CN); Cheng Zhao, Shandong (CN); Ying Zhong, Shandong (CN); Rui Guo, Shandong (CN); Yao Xue, Shandong (CN); Chao Zhang, Shandong (CN); Yawei Li, Shandong (CN)

(73) Assignee: GOERTEK INC., Weifang (CN)

( * ) Notice: Subject to any disclaimer, the term of this patent is extended or adjusted under 35 U.S.C. 154(b) by 84 days.

(21) Appl. No.: 17/564,951

(22) Filed: Dec. 29, 2021

(65) Prior Publication Data

US 2023/0020875 A1 Jan. 19, 2023

(30) Foreign Application Priority Data

Jul. 6, 2021 (CN) ..... 202110764653.7
Jul. 6, 2021 (CN) ..... 202110765149.9
Jul. 6, 2021 (CN) ..... 202121530945.6

(51) Int. Cl.
*A44C 5/00* (2006.01)

(52) U.S. Cl.
CPC ..... *A44C 5/0061* (2013.01)

(58) Field of Classification Search
CPC ..... A44C 5/0061; A44C 5/2071; A44C 5/147; A44C 5/12; A44C 5/00; A44C 5/0053;
(Continued)

(56) References Cited

U.S. PATENT DOCUMENTS 2,947,455 A * 8/1960 Straub ..... A44C 5/12 224/168
4,573,221 A * 3/1986 Hirsch ..... A44C 5/0053 2/338

(Continued)

FOREIGN PATENT DOCUMENTS

CH 518696 A * 2/1972 ..... A44C 5/12
CN 203058579 7/2013

(Continued)

OTHER PUBLICATIONS

European Extended Search Report and Opinion for European Application No. 21218227.3, dated May 25, 2022, 6 pages.

(Continued)

*Primary Examiner* — Jack W Lavinder
(74) *Attorney, Agent, or Firm* — HAUPTMAN HAM, LLP

(57) ABSTRACT

Disclosed is wristband and wrist wearable device, including: a wristband body portion, one end is connected to one end of a device body of a wrist wearable device, and the other end is a free end; and a memory metal portion, which is arranged on the wristband body portion and has an arc-shaped memory state in a natural state, so that the wristband body portion is naturally maintained in an arc shape. The memory metal portion comprises a strip-shaped memory metal piece including a first metal segment, a second metal segment, and a third metal segment that are sequentially connected, the first metal segment and the third metal segment extend along a length direction of the wristband body portion in parallel, the second metal segment is arranged at the free end of the wristband body portion and is provided with at least one bent portion.

5 Claims, 10 Drawing Sheets

(58) Field of Classification Search
CPC ..... A44C 5/185; A44C 5/14; Y10T 24/47; Y10T 24/4718
See application file for complete search history.

(56) References Cited

U.S. PATENT DOCUMENTS

| | | | | |
|---|---|---|---|---|
| 9,609,921 | B1 | 4/2017 | Feinstein | |
| 2017/0086536 | A1 | 3/2017 | de Iuliis et al. | |
| 2021/0085041 | A1* | 3/2021 | Schlichtig | G04B 37/22 |

FOREIGN PATENT DOCUMENTS

| | | | | | |
|---|---|---|---|---|---|
| CN | 206499033 | | | 9/2017 | |
| CN | 207010923 | | | 2/2018 | |
| CN | 209528089 | | | 10/2019 | |
| CN | 112369767 | | | 2/2021 | |
| CN | 212697930 | | | 3/2021 | |
| DE | 29700982 | U1 | * | 4/1997 | A44C 5/12 |
| EP | 1269879 | A1 | * | 1/2003 | A44C 5/14 |
| JP | H11239506 | | | 9/1999 | |
| JP | 2000300313 | | | 10/2000 | |
| JP | 2008136723 | | | 6/2008 | |
| JP | 2018117903 | A | * | 8/2018 | A44C 5/00 |
| KR | 20060058619 | | | 5/2006 | |
| KR | 20090113348 | | | 10/2009 | |
| KR | 20150028318 | A | * | 12/2013 | A44C 5/14 |

OTHER PUBLICATIONS

Chinese First Office Action for Chinese Application No. 202110764653.7, dated Mar. 2, 2022, 15 pages with translation.

Chinese First Office Action for Chinese Application No. 202110765149.9, dated Aug. 26, 2022, 12 pages with translation.

* cited by examiner

WRISTBAND AND WRIST WEARABLE DEVICE

CROSS REFERENCE TO RELATED DISCLOSURES

The present disclosure claims the priority to the following three Chinese Patent Applications: 1) Chinese Patent Application No. 202110764653.7 titled "WRISTBAND AND WRIST WEARABLE DEVICE", filed with the China National Intellectual Property Administration on Jul. 6, 2021, 2) Chinese Patent Application No. 202110765149.9 titled "WRISTBAND AND WRIST WEARABLE DEVICE", filed with the China National Intellectual Property Administration on Jul. 6, 2021, 3) Chinese Patent Application No. 202121530945.6 titled "WRISTBAND AND WRIST WEARABLE DEVICE", filed with the China National Intellectual Property Administration on Jul. 6, 2021, all of which are incorporated herein by reference in their entireties.

FIELD

The present disclosure relates to the technical field of wrist wearable devices, and in particular to a wristband and a wrist wearable device.

BACKGROUND

With the development of electronic technology, wrist wearable devices are becoming more and more popular among people. A wrist wearable device generally includes a device body and a flexible wristband, where the device body is configured to display image information to a user, and the wristband is configured to enable the device body to be worn on a wrist or ankle of the user. In the conventional wrist wearable device, since the flexible wristband has no supporting effect and position-limiting effect, it is generally necessary to provide a wristband buckle on one wristband and multiple adjustment holes on the other wristband. The wristband buckle and the adjustment holes are cooperated to connect two wristbands together, so that the wrist wearable device can be stably worn on the wrist of the user. However, this wearing manner needs the user to buckle or unbuckle the wristband buckle as wearing and putting off the wrist wearable device, which is inconvenient to operate and greatly affects the experience of the user.

SUMMARY

A main object of the present disclosure is to provide a wristband, which aims to enable the user to wear a wrist wearable device on a wrist or put off the wrist wearable device from the wrist conveniently and rapidly, so as to improve the usage experience of the user.

In order to achieve the above object, a wristband provided according to the present disclosure includes:

a wristband body portion, one end of the wristband body portion is configured to connect to one end of a device body of a wrist wearable device, and the other end of the wristband body portion is a free end; and a memory metal portion, the memory metal portion is arranged on the wristband body portion, and the memory metal portion has an arc-shaped memory state in a natural state, so that the wristband body portion is naturally maintained in an arc shape, and the wristband is naturally maintained in a wearing state.

In an embodiment, the wristband further includes a connecting portion, where the connecting portion is configured to be connected with one end of the device body of the wrist wearable device.

In an embodiment, the memory metal portion includes a strip-shaped memory metal piece, and the memory metal piece includes a first metal segment, a second metal segment, and a third metal segment that are sequentially connected, where the first metal segment and the third metal segment both extend along a length direction of the wristband body portion and are arranged in parallel, the second metal segment is arranged at the free end of the wristband body portion, and the second metal segment is provided with at least one bent portion.

In an embodiment, the wristband body portion is made of fabric and/or soft rubber and/or hard rubber.

In an embodiment, the connecting portion is connected to the memory metal portion by welding, adhesive bonding, or screwing;

or the memory metal portion is integrally formed with the connecting portion by insert injection molding.

In an embodiment, after the memory metal portion is connected to the connecting portion, the memory metal portion is integrally formed with the wristband body portion by insert injection molding.

In an embodiment, the memory metal portion includes a strip-shaped memory metal piece, the memory metal piece is bent into a U-shape or a U-like shape first, and then is bent into a whole arc shape; two ends of an opening of the memory metal piece in U-shape or U-like shape are arranged to be close to each other, and the memory metal piece is connected to the connecting portion by the two ends being close to each other.

In an embodiment, there are two wristbands, and there is a gap between free ends of the two wristband body portions; or the free ends of the two wristband body portions are overlapped with each other; or the free ends of the two wristband body portions are staggered and parallel to each other; or the free ends of the two wristband body portions are connected to each other; or there is one wristband, and the free end of the wristband body portion is arranged to be close to the other end of the device body.

In an embodiment, in a case that the free ends of the two wristband body portions are overlapped with each other, at least one of two opposite surfaces of the two overlapped free ends is provided with an embossment.

In an embodiment, a mounting hole located inside the bent portion is arranged at a free end of at least one of the wristband body portion.

In an embodiment, there are two wristbands, and the free ends of the two wristband body portions are overlapped with each other;

a mounting hole of at least one wristband body portion is provided with a protruding piece protruding toward a free end of the other wristband body portion, and the other wristband body portion is provided with a concave hole corresponding to the protruding piece, and the protruding piece is at least partially inserted into the concave hole.

In an embodiment, the wristband body portion includes a body segment and a free segment that are connected to each other, and the free segment is formed as a free end of the wristband body portion; the free segment is made of hard material, and the protruding piece is arranged at the free segment.

In an embodiment, the free segment and the body segment are integrally formed by injection molding; and/or, the free segment is buckled with the second metal segment.

In an embodiment, multiple concave holes are arranged on the wristband body portion at intervals along an extension direction of the wristband body portion.

In an embodiment, an end of the first metal segment away from the second metal segment and an end of the third metal segment away from the second metal segment are both connected to the connecting portion, and the end of the first metal segment away from the second metal segment and the end of the third metal segment away from the second metal segment are arranged close to each other.

In an embodiment, there are two wristbands, and a radian of the wristband body portion of each wristband is less than λ.

In an embodiment, there are two wristbands, an end of the wristband body portion of one of the wristbands is connected to an end of the device body, and an end of the wristband body portion of the other of the wristbands is connected to the other end of the device body, and the two wristbands jointly enclose a wearing space of the wrist wearable device; or there is one wristband, a wristband body portion thereof is arranged in a major arc shape, and the other end of the wristband body portion is arranged close to the other end of the device body.

In an embodiment, in a case that there are two wristbands;

there is a gap between free ends of the two wristband body portions; or the free ends of the two wristband body portions are overlapped with each other; or the free ends of the two wristband body portions are staggered and parallel to each other; or the free ends of the two wristband body portions are connected to each other.

In an embodiment, the memory metal portion includes multiple strip-shaped memory metal pieces that are parallel to each other, and the memory metal pieces are strip-shaped along a length direction of the wristband body portion, and at least two memory metal pieces are arranged close to opposite sides of the wristband body portion, respectively; or the memory metal portion includes multiple strip-shaped memory metal pieces, at least one of the memory metal pieces has at least one bent portion in a plane in parent phase, and the memory metal piece is bent relative to one side of the plane in parent phase as an inner side to from ring-shape; in a case that there are multiple memory metal pieces with the bent portions, the bent portions of at least two of the memory metal pieces intersect or do not intersect with each other; or the memory metal portion includes a strip-shaped memory metal piece, and the memory metal piece is bent into a U-shape first, and then is bent into a whole arc shape at the second time.

In an embodiment, a mounting cavity is arranged on the wristband body portion, the mounting cavity penetrates through the free end of the wristband body portion, and the memory metal portion is accommodated and mounted in the mounting cavity; the wristband is further provided with a cap, and the cap is covered on the free end of the wristband body portion.

In an embodiment, the memory metal portion is embodied as a memory metal wire, and an end of the memory metal wire is arranged in a spherical or a spherical-like shape; and/or a positioning groove for accommodating or adapting the end of the memory metal wire in the spherical or spherical-like shaped is formed on the cap.

A wrist wearable device is further provided according to the present application, and the wrist wearable device includes a device body and the above wristband.

In an embodiment, a mounting slot is arranged at an end of the device body, and a buckling hole is arranged at the mounting slot; the connecting portion of the wristband is connected to the mounting slot in a pluggable manner, and a buckling groove is arranged on the connecting portion;

the wrist wearable device further includes a buckling block; after the connecting portion is inserted into the mounting slot, the buckling groove aligns with the buckling hole, the buckling block penetrates through the buckling hole and is buckled into the buckling groove, and the buckling block is magnetically attracted to the connecting portion to lock the wristband in the mounting slot.

In an embodiment, at least one of the connecting portion and the buckling block is a magnet, at most one of the connecting portion and the buckling block is made of magnetic metal material.

In the present application, one end of the wristband body portion is configured to be connected with an end of the device body, and the other end of the wristband body portion is a free end. The memory metal portion has an arc-shaped memory state in a natural state, so that the wristband body portion is naturally maintained in an arc shape, and the wristband is naturally maintained in a wearing state. In this way, on the one hand, the wristband buckle and the related connection structure of which can be omitted, thereby saving material cost and assembly cost; on the other hand, the user does not need to align and buckle the wristband buckle when wearing it, and the user can put off the wristband without unbuckling, which enables the user to wear the wrist wearable device on the wrist or put off the wrist wearable device from the wrist conveniently and rapidly, so as to improve the usage experience of the user. In addition, the second metal segment of the memory metal portion provided with several bent portions is arranged on the free end of the wristband body portion, and because the structural strength of the bent portion is relatively high, the structural strength of the wristband body portion can be enhanced, and the structural stability of the product can be improved.

BRIEF DESCRIPTION OF THE DRAWINGS

For more clearly illustrating embodiments of the present disclosure or the technical solutions in the conventional technology, drawings referred to for describing the embodiments or the conventional technology will be briefly described hereinafter. Apparently, drawings in the following description are only examples of the present application, and for the person skilled in the art, other drawings may be obtained based on the provided drawings without any creative efforts.

REFERENCE NUMERALS IN FIGS. 1 TO 16

| | |
|---|---|
| 100 wristband; | 110 wristband body portion; |
| 110a fabric body; | 110b soft rubber edging; |
| 110c body segment; | 110d free segment; |
| 111 embossment; | 112 protruding piece; |
| 113 concave hole; | 114 mounting hole; |
| 120 memory metal portion; | 120a memory metal piece; |
| 121 first metal segment; | 122 second metal segment; |
| 123 third metal segment; | 122a bent portion; |
| 130 connecting portion | 131 buckling groove; |
| 132 fixing hole; | 140 cap; |
| 141 clamping sheet portion; | 140a positioning groove; |
| 200 device body; | 201 mounting slot; |
| 202 buckling hole; | 203 relieving notch; |
| 300 buckling block; | 400 connecting screw. |

The realization of the objects, functional characteristics and advantages of the present disclosure will be further described in conjunction with the embodiments and with reference to the drawings.

DETAILED DESCRIPTION OF THE EMBODIMENTS

The technical solutions according to the embodiments of the present disclosure will be described clearly and completely as follows in conjunction with the drawings in the embodiments of the present application. It is apparent that the described embodiments are only a part of the embodiments according to the present application, rather than all of the embodiments. Based on the embodiments of the present application, all other embodiments obtained without creative efforts by those of ordinary skill in the art shall fall within the protection scope of the present application.

In the present application, a relation term such as "first" and "second" herein is only used to distinguish one entity or operation from another entity or operation, and does not necessarily require or imply that there is an actual relation or sequence between these entities or operations. Moreover, the terms "comprise", "include", or any other variants thereof are intended to encompass a non-exclusive inclusion, such that the process, method, article, or device including a series of elements includes not only those elements but also those elements that are not explicitly listed, or the elements that are inherent to such process, method, article, or device. Unless explicitly limited, the statement "including a . . . " does not exclude the case that other similar elements may exist in the process, the method, the article or the device other than enumerated elements.

Figure 1:
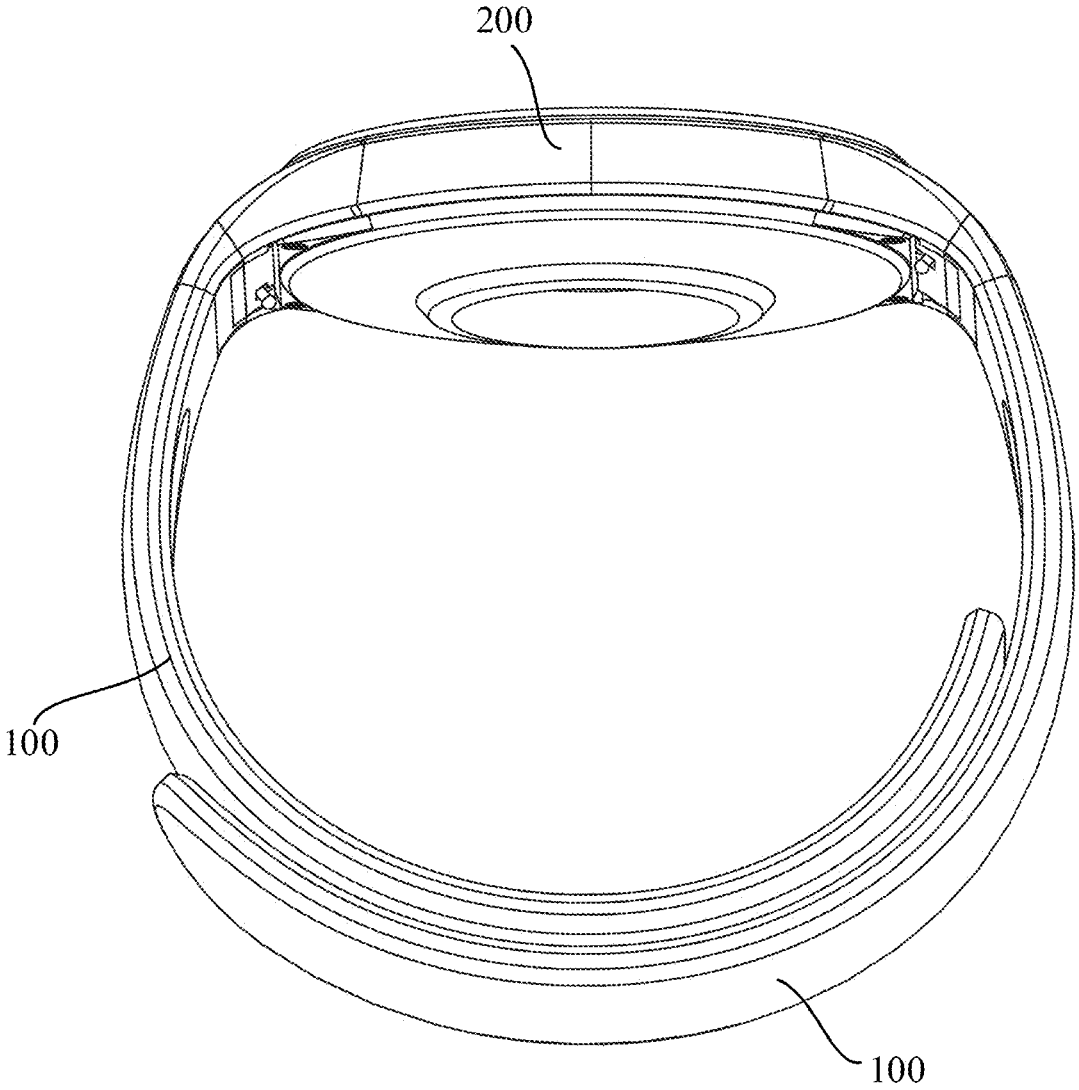
FIG. 1 is a schematic structural view of a first embodiment of a wrist wearable device of the present application.
Figure 4:
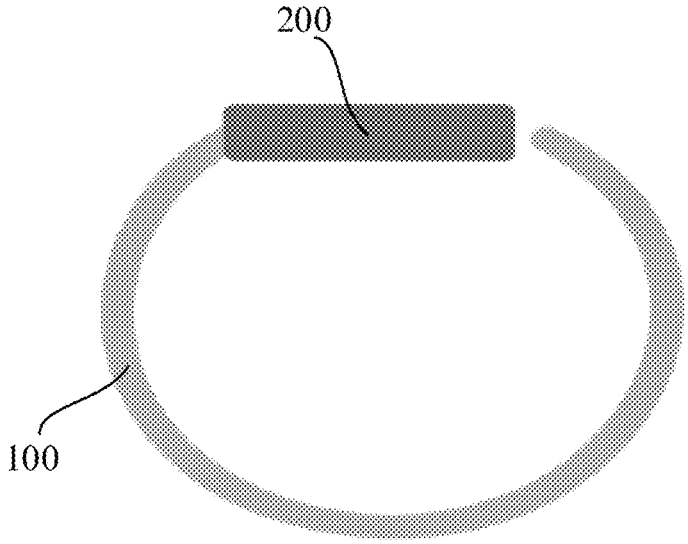
FIG. 4 is a schematic structural view of a third embodiment of the wrist wearable device of the present application.

A wrist wearable device is provided according to the present application. Referring to FIGS. 1 and 4, the wrist wearable device generally includes a wristband 100 and a device body 200. One end of the wristband 100 is connected to an end of the device body 200, and the other end of the wristband 100 is a free end. The device body 200 may be embodied as a watch body (e.g., may be a normal watch dial, a smart watch dial, or a bracelet body, etc.), or a health monitoring module (generally refers to a watch body without a screen display function, e.g., the health monitoring module is equipped with a monitoring sensor for monitoring heart rate, blood pressure of the user, and may be also equipped with a sensor for monitoring state of exercise, the number of walking steps, etc.). In the present application, the wristband 100 has an arc-shaped wearing state, and the wearing state of which can be naturally maintained, that is, the wristband 100 can be maintained in the arc-shaped state even in a non-wearing state. Without loss of generality, in an embodiment of the present application, there are generally two wristbands 100, and the device body 200 is connected between the two wristbands 100. Of course, in other embodiments, there may also be only one wristband 100, and the wristband 100 is arranged in a major arc shape, which will be further described hereinafter.

It should be noted that the arc-shaped wearing state of the wristband 100 in the present disclosure refers to that the wristband 100 has only one form in a natural state, that is, the wristband 100 is only naturally maintained in an arc-shaped state, which is different from a clap ring. In the natural state, the clap ring may have two forms, one is a straight form, and the other is an arc (circular) form. The clap ring in straight form can be transformed into the arc form to be wearable after clapping the wrist. Of course, it should be noted that in the present application, the wristband 100 "only being maintained in an arc-shaped state" is not intended to limit the deformability of the wristband 100. At least, under the action of external force, the free end of the wristband 100 can be deformed and splayed outwards, so that the user can wear or put off the wrist wearable device from the wrist, and when the external force disappears, the deformation of the wristband 100 can self-recover and return to the arc-shaped wear state.

Figure 2:
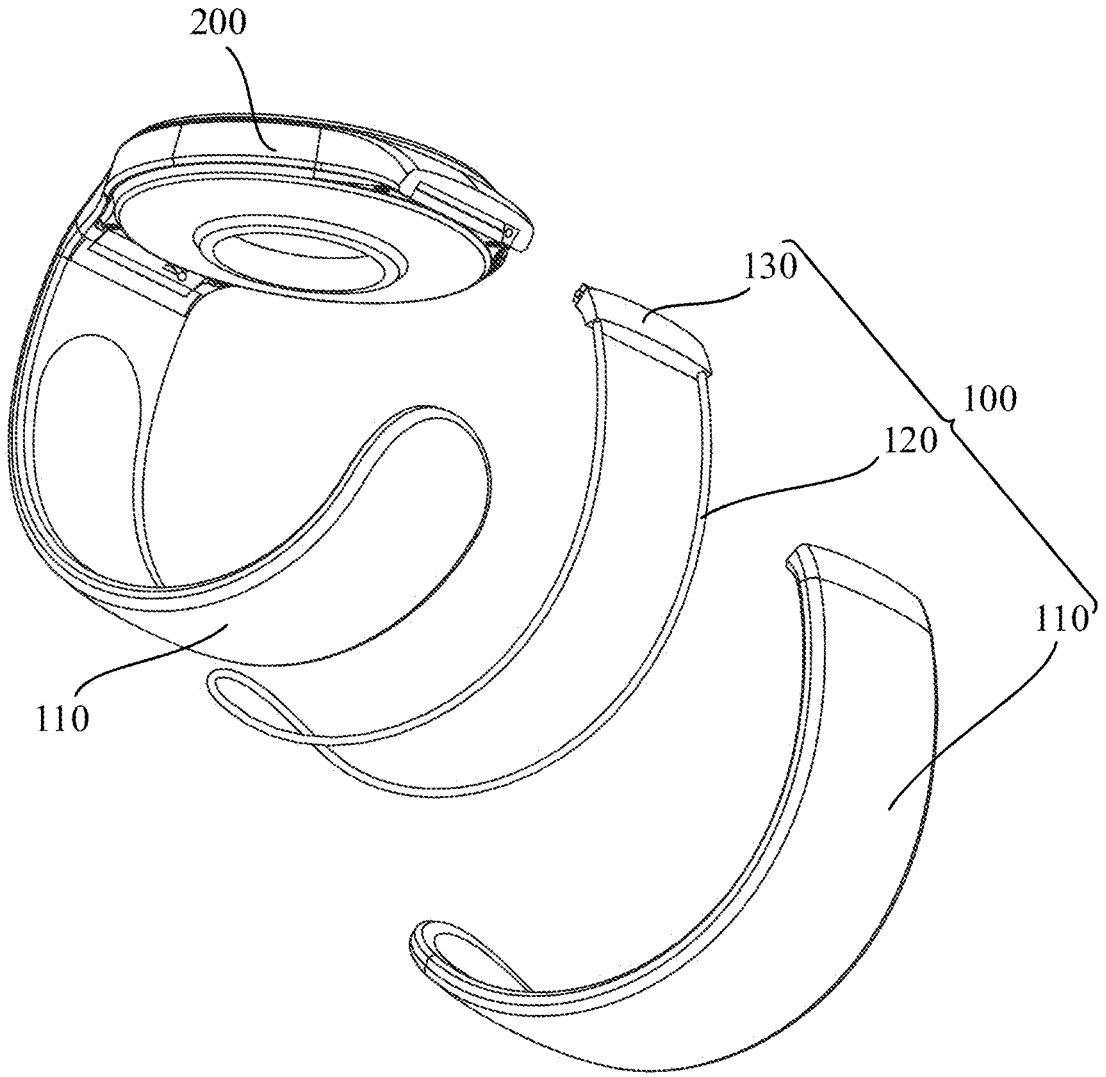
FIG. 2 is a schematic explosive view of the wrist wearable device shown in FIG. 1.

Referring to FIGS. 1 and 2, in an embodiment of the present application, the wristband 100 includes a wristband body portion 110 and a memory metal portion 120 arranged on the wristband body portion 110, where one end of the wristband body portion 110 is configured to be connected to one end of a device body 200, and the other end of the wristband body portion 110 is a free end. The memory metal portion 120 has an arc-shaped memory state in a natural state, so that the wristband body portion 110 is naturally maintained in an arc shape, and the wristband 100 is naturally maintained in a wearing state. In this way, on the one hand, the wristband buckle and its related connection structure can be omitted, thereby saving material cost and assembly cost; on the other hand, the user does not need to align and buckle the wristband buckle when wearing the wristband, and the user can put off the wristband without unbuckling, which enables the user to wear the wrist wearable device on the wrist or put off the wrist wearable device from the wrist conveniently and rapidly, so as to improve the usage experience of the user.

It can be understood that memory metal is super-flexibility, which means that under the action of external force, the memory metal has much larger deformation recovery ability than ordinary metals, that is, a large strain generated in the loading process (e.g. the wearing process/putting off process) will be eliminated as unloading, so as to return to a memory shape (arc shape).

Figure 3:
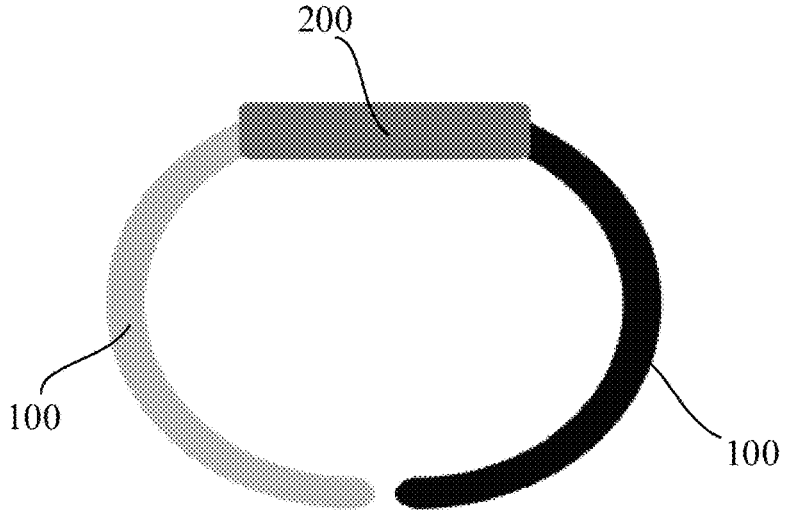
FIG. 3 is a schematic structural view of a second embodiment of the wrist wearable device of the present application.

In an embodiment, each device body 200 is provided with two wristbands 100, an end of a wristband body portion 110 of one wristband 100 is connected to an end of the device body 200, and an end of a wristband body portion 110 of the other wristband 100 is connected to the other end of the device body 200, and these two wristbands 100 jointly enclose a wearing space of the wrist wearable device. In an embodiment, referring to FIG. 3, free ends of the two wristbands 100 are close to each other, but not in contact with each other, that is, there is a gap between the free ends of each of two wristband body portions 110. In this case, the user forces the two wristbands 100 apart or keeps the two wristbands 100 open, so that an opening between the two wristbands 100 can be suitable for the wrist to enter and exit, so as to wear the wrist wearable device on the wrist or put off the wrist wearable device from the wrist conveniently and rapidly. However, the present disclosure is not limited hereto, in some other embodiments, the free ends of the two wristband body portions 110 are overlapped with each other (referring to FIG. 1); in yet other embodiments, the free ends of the two wristband body portions 110 may be staggered and parallel; in yet other embodiments, the free ends of the two wristband body portions 110 may also be abutted to each other.

In a further embodiment, in a case that there are two wristbands 100, the radian of the wristband body portion 110 of each wristband 100 is less than $\pi$, that is, the wristband body portion 110 of each wristband 100 is arranged in a minor arc shape. It can be understood that, due to of the presence of the device body 200, the two wristbands 100 can be enclosed to form a shape that stably surrounds the user's wrist without the radian equaling to $\lambda$, so as to ensure the wearing stability while saving the material of the wristband 100, thereby reducing material cost. However, the present disclosure is not limited hereto, in some embodiments, even in a case that there are two wristbands 100, the radian of the wristband body portion 110 of each wristband 100 can be greater than or equal to $\pi$, that is, the wristband body portion 110 of each wristband 100 can also be arranged in a major arc shape.

It should be noted that, in another embodiment, referring to FIG. 4, there may be only one wristband 100, that is, one device body 200 is equipped with one wristband 100, and the free end of the wristband body portion 110 is arranged close to the other end of the device body 200, and the radian of the wristband body portion 110 of the wristband 100 is greater than or equal to $\pi$, that is, the wristband body portion 110 of the wristband 100 is arranged in a major arc shape. In this case, when the user forces the free end of wristband 100 apart or keeps the free end of the wristband 100 open to form an opening that is sufficient for the wrist to enter and exit between the free end and the device body 200, so that the wrist can freely enter and exit the wearing ring, the wrist wearable device can be worn on the wrist or put off from the wrist conveniently and rapidly. It can be understood that, if the radian of the wristband body portion 110 is too small, it will be difficult to realize the wearing stability of the wrist wearable device with a single wristband, and if the radian of the wristband body portion 110 is too great, the free end of the wristband body portion 100 will be partially overlapped at the inner side of the device body 200, which causes discomfort to the user when wearing it, and deteriorate the user experience. In this embodiment, optionally, a radian of the wristband body portion 110 ranges from 1.3 $\pi$ to 1.8 $\pi$, which is moderate with compromise between the wearing stability and the wearing comfort.

Figure 8:
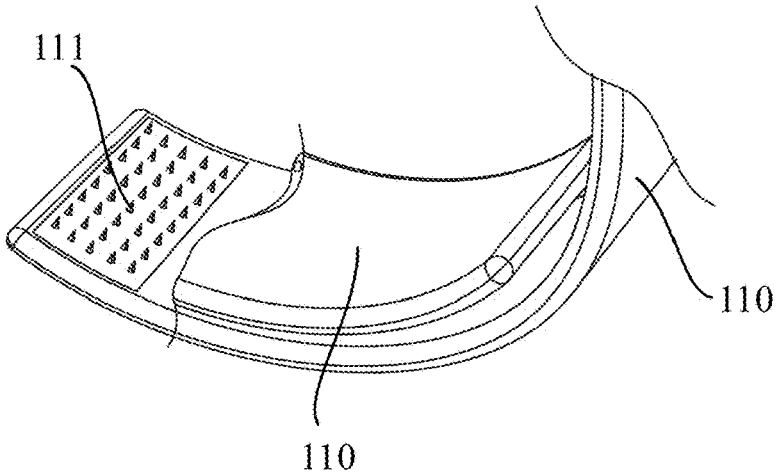
FIG. 8 is a schematic structural view of a embossment on the wristband body portion of the wristband of the wrist wearable device of the present application.

In an embodiment, referring to FIG. 8, in a case that the free ends of the two wristband body portions 110 are overlapped with each other, at least one of two opposite surfaces of the two overlapped free ends is provided with embossments 111, and these embossments 111 may be in a dotted and flatten shape, and also be thorn-shaped or barb-shaped. Generally, there are multiple embossments 111 to form a group of embossments. It should be understood that the embossments 111 are provided to increase the frictional force between the two opposite surfaces of the two overlapped free ends, and to reduce the probability of displacement along the length of the wristband body portion 110 between the two overlapped free ends, thereby improving the wearing stability of the wristband 100. Particularly, since the frictional force when the sliding displacement appeared between the two opposite surfaces is increased without increasing a connection force between the two overlapped free ends in a direction perpendicular to the outer surface of the wristband body portion 110 (the conventional hook and loop mainly increases such connection force). That is, when the two free ends of the two wristband body portions 110 are forced apart outwards (the force is almost perpendicular to the outer surface of the wristband body portion 110) to wear or put off the wristband 100, the embossments 111 will not cause any obstruction, so that no extra effort will be paid for wearing and putting off the wristband 100.

Especially for thorn-shaped or barb-shaped embossments, preferably, the embossments are soft rubber-embossments. During wearing, as the user vigorously shakes the wrist, it will cause vertical squeezing force and horizontal relative displacement inertia between the two overlapped ends of the wristbands 100, where the vertical squeezing force will squeeze the soft rubber embossments vertically, and the horizontal relative displacement inertia will stretch the soft rubber embossments in the horizontal direction, so that the contact area between the soft rubber embossments and the opposite wristband 100 and/or another set of soft rubber embossments on the opposite wristband 100 is increased, which further increases the frictional force between the overlapped ends of the wristbands 100, and prevents the overlapped ends of the wristbands 100 from being staggered, thereby preventing the wristbands 100 from slipping off the wrist. In an embodiment, especially in a case that soft rubber embossments are arranged on the two opposite surfaces of the two overlapped ends, when the wristbands 100 are worn on the wrist and shaken, the vertical squeezing force and the horizontal relative displacement inertia will squeeze and deform the two sets of soft rubber embossments, which thereby adhere and wind together, so that the wearing of the wristband 100 is more stable and reliable. Therefore, the wristband 100 of the present disclosure does not need the assistance of a wristband buckle and the concern of slippage is not necessary.

In other embodiments of the present application, soft rubber or hard rubber materials may also be adopted for flat embossments.

Therefore, the memory metal portion 120 of the present disclosure can realize that the wrist wearable device is stably supported and worn on the user's wrist without buckling the wristband buckle; the embossments 111 at an end of the wristband body portion 110 is configured to prevent the two ends of the wristband body portion 110 from being staggered, so as to prevent the size of the wristband ring from expanding and thus slipping off the wrist, which further increases the wearing stability. In addition, the arrangement of the memory metal portion 120 and the embossments 111 also avoids the buckling operation and unbuckling operation to the wristband buckle of the traditional wrist wearable device during the wearing process and putting-off process, which makes the wearing and putting-off process easier.

In an embodiment, a mounting cavity is arranged in the wristband body portion 110, and the memory metal portion 120 is accommodated and mounted in the mounting cavity, that is, the memory metal portion 120 is arranged in the wristband body portion 110, so that the memory metal portion 120 is physical protected by the wristband body portion 110.

Figure 5:
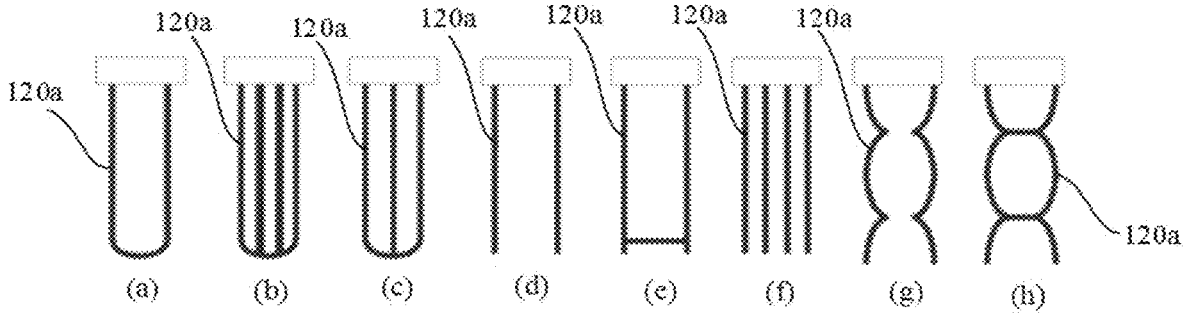
FIG. 5 are schematic views of various structures of a memory metal portion of a wristband of the wrist wearable device of the present application.

Optionally, the memory metal portion 120 includes a memory metal wire and/or a memory metal sheet. In order to save material, the memory metal portion 120 generally adopts a memory metal wire or a memory metal narrow sheet. Referring to FIGS. 5(*d*), 5(*e*), and 5(*f*), in an embodiment, the memory metal portion 120 includes multiple strip-shaped memory metal pieces 120*a* (in a shape of filament or narrow sheet) arranged in parallel, the memory metal pieces 120*a* are in a strip shape extending along the length direction of the wristband body portion 110, and at least two of the memory metal pieces 120*a* are arranged close to two opposite sides of the wristband body portion 110, respectively. In another embodiment, the memory metal portion 120 includes a strip-shaped memory metal piece 120*a* (in a shape of filament or narrow sheet), and the memory metal piece 120*a* is continuously flexuous in a plane in parent phase, which is in a memory shape of arc shape under memory state, and has multiple bent portions, and the memory metal piece 120*a* is bent relative to one side of the plane in parent phase (as an inner side) so as to form in ring-shape. Referring to FIG. 5(*g*), in yet another embodiment, the memory metal portion 120 includes two strip-shaped memory metal pieces 120*a* (in a shape of filament or narrow sheet), each of the memory metal pieces 120*a* has at least one bent portion in the parent phase, the memory metal piece 120*a* is bent about one side of the plane in parent phase as an inner side to form in ring-shape, and the bent portions of the two memory metal pieces 120*a* do not intersect with each other. Referring to FIG. 5(*h*), in yet another embodiment, the memory metal portion 120 includes two strip-shaped memory metal pieces 120*a* (in a shape of filament or narrow sheet), and each of the memory metal pieces 120*a* is continuously flexuous in the plane in parent phase and has multiple bent portions, the memory metal piece 120*a* is bent about one side of the plane in parent phase as an inner side to form in ring-shape, and the bent portions of the two memory metal pieces 120*a* are intersected with each other. Referring to FIG. 5(*a*), in yet another embodiment, the memory metal portion 120 includes one strip-shaped memory metal piece 120*a*, where the memory metal piece 120*a* is bent into a U shape first and is bent into a whole arc shape next. It should be noted that in addition to the configuration of the memory metal portion 120 described above, the memory metal portion 120 may also have other configurations, such as but not limited to those shown in FIGS. 5(*b*) and 5(*c*).

In an embodiment, referring to 6, the mounting cavity penetrates through the free end of the wristband body portion 110, and the wristband 100 is further provided with a cap 140, which is covered on the free end of the wristband body portion 110. In this embodiment, the cap 140 is configured to prevent the memory metal portion 120 from being exposed at the free end of the wristband body portion 110. In an embodiment, the cap 140 may be made of soft rubber, hard rubber, metal, etc. In a further embodiment, the cap 140 may be connected to the wristband body portion 110 by but not limited to, thermal-press connection, adhesive connection, etc.

In an embodiment, in a case that the memory metal portion 120 is embodied as a memory metal wire, an end of the memory metal wire is arranged in a spherical shape or a spherical-like shape, so as to reduce the sharpness of the end of the memory metal wire and reduce the probability of the end of the memory metal wire penetrating through the wristband body portion 110. It should be understood that the spherical or spherical-like structure at the end of the memory metal wire is thickened, that is, the diameter of the spherical or spherical-like structure is larger than the diameter of the memory metal wire.

Figure 6:
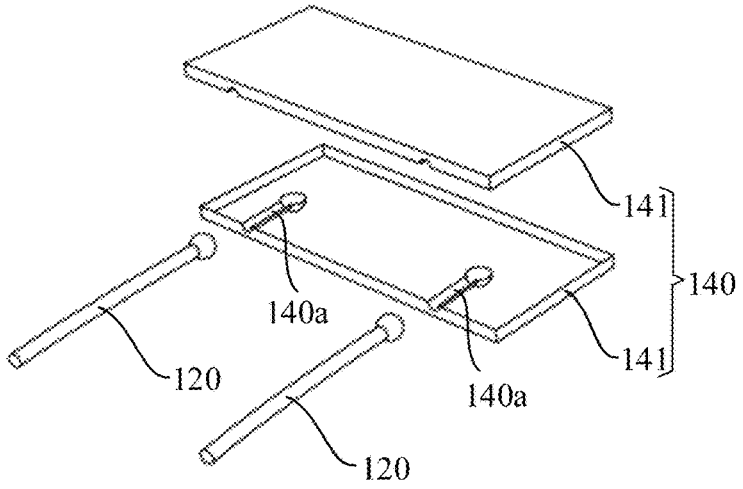
FIG. 6 is a schematic structural view between the memory metal portion of the wristband and a cap.

In an embodiment, a positioning groove 140*a* for accommodating the spherical or spherical-like shaped end of the memory metal wire is formed in the cap 140, so as to prevent the end of the memory metal wire from detaching from the cap 140 and reduce the slippage of the memory metal wire relative to the mounting cavity. In a further embodiment, referring to FIG. 6, the cap 140 is in a shape of clamping sheet, and includes two clamping sheet portions 141 arranged opposite. A half portion of the positioning groove 140*a* is arranged on each of the clamping sheet portions on the surface facing the other clamping sheet portion 141.

Figure 7:
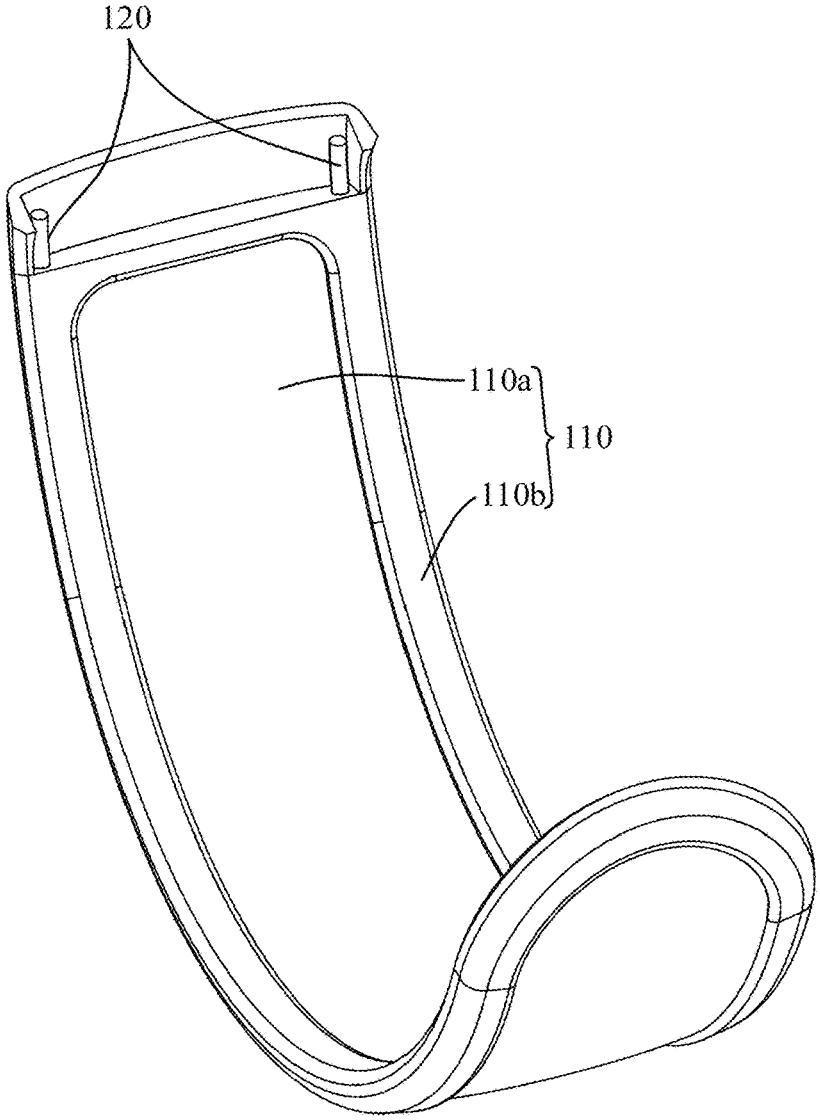
FIG. 7 is a schematic structural view of an embodiment of the wristband of the wrist wearable device of the present application.

Further, the wristband body portion 110 is made of fabric and/or soft rubber and/or hard rubber. It should be noted that, in addition that the wristband body portion 110 is made of single fabric or single soft rubber or single hard rubber (Particularly, in a case that the wristband body portion 110 is made of single hard rubber, the whole wristband body portion 110 is embodied as a long strip shape and has sufficient bendable flexibility), the wristband body portion 110 may also be made of two or more of the above materials. For example, referring to FIG. 7, the wristband body portion 110 may include a band-shaped fabric body 110*a* and a soft rubber edging 110*b* covering the edge of the fabric body 110*a*. The fabric body 110*a* has good air permeability, and the soft rubber edging 110*b* is configured to provide a better styling effect, and to prevent the edge of the fabric body 110*a* from being rough selvedge, and to reduce the dirt and contamination on the edge of the wristband body portion 110 (compared to the fabric, it is not easy for the soft rubber to get dirty contaminated, and even if it does, it is easy to clean). In an embodiment, a soft rubber film layer can be further provided at the inner side of the fabric body 110*a* to isolate sweat and the like, so as to reduce the probability of the fabric body 110*a* being contaminated by sweat and the like. In a further embodiment, the soft rubber film layer is provided with vent holes, which facilitates of ensuring good air permeability of the wristband body portion 110.

In an embodiment, referring to FIG. 2, the wristband 100 further includes a connecting portion 130, which is provided at the end of the wristband body portion 110 configured to connect the device body 200, and the connecting portion 130 is fixedly connected to the memory metal portion 120. It should be understood that, regarding the arrangement of the connecting portion 130, a structure for connecting the device body 200 can be arranged on the connecting portion 130, which is beneficial to the stability of the connection structure between the wristband 100 and the device body 200.

In an embodiment, the connecting portion 130 is made of a metal material or a hard plastic material to ensure the connecting portion 130 with a certain structural rigidity, so that the connection stability between the wristband 100 and the device body 200 is ensured. In a case that the connecting portion 130 is made of metal material, the connecting portion 130 can be connected to the memory metal portion 120 by welding or screwing; in a case that the connecting portion 130 is made of hard plastic material, the connecting portion 130 can be connected to the memory metal portion 120 by adhering or screwing, or the memory metal portion 120 is integrally formed with the connecting portion 130 by insert injection molding, so as to reduce the mounting processes between the connecting portion 130 and the memory metal portion 120, and effectively improve the connection stability between the memory metal portion 120 and the connecting portion 130. Particularly, in a case that the connecting portion 130 and the memory metal portion 120 are connected by screwing, the specific arrangement may be: referring to FIG. 16, the memory metal portion 120 is embodied as a memory metal wire, a fixing hole 132 is provided so as to penetrate the connecting portion 130. A screw hole is arranged at an end of the memory metal wire. A connecting screw 400 and the end of the memory metal wire penetrate the fixing hole 132 from two ends of the fixing hole 132, respectively, so that the connecting screw 400 and the end of the memory metal wire are locked and coupled in the fixing hole 132.

In an embodiment, the molding process of the wristband 100 may be as follows: after the memory metal portion 120 and the connecting portion 130 are connected to be integrated, the memory metal portion 120 and the wristband body portion 110 (the wristband body portion 110 is generally made of soft rubber) are integrally formed by insert injection molding. In this way, the injection molding method is beneficial to the mass production of products and the improvement of production efficiency, and the stability of the connection between the connecting portions 130 is ensured. Of course, in other embodiments, the molding process of the wristband 100 may also be as follows: the mounting cavity is formed on the wristband body portion 110, and the memory metal portion 120 fixed to the connecting portion 130 is inserted into the mounting cavity, and the connecting portion 130 is connected and fixed to the wristband body portion 110.

Figure 9:
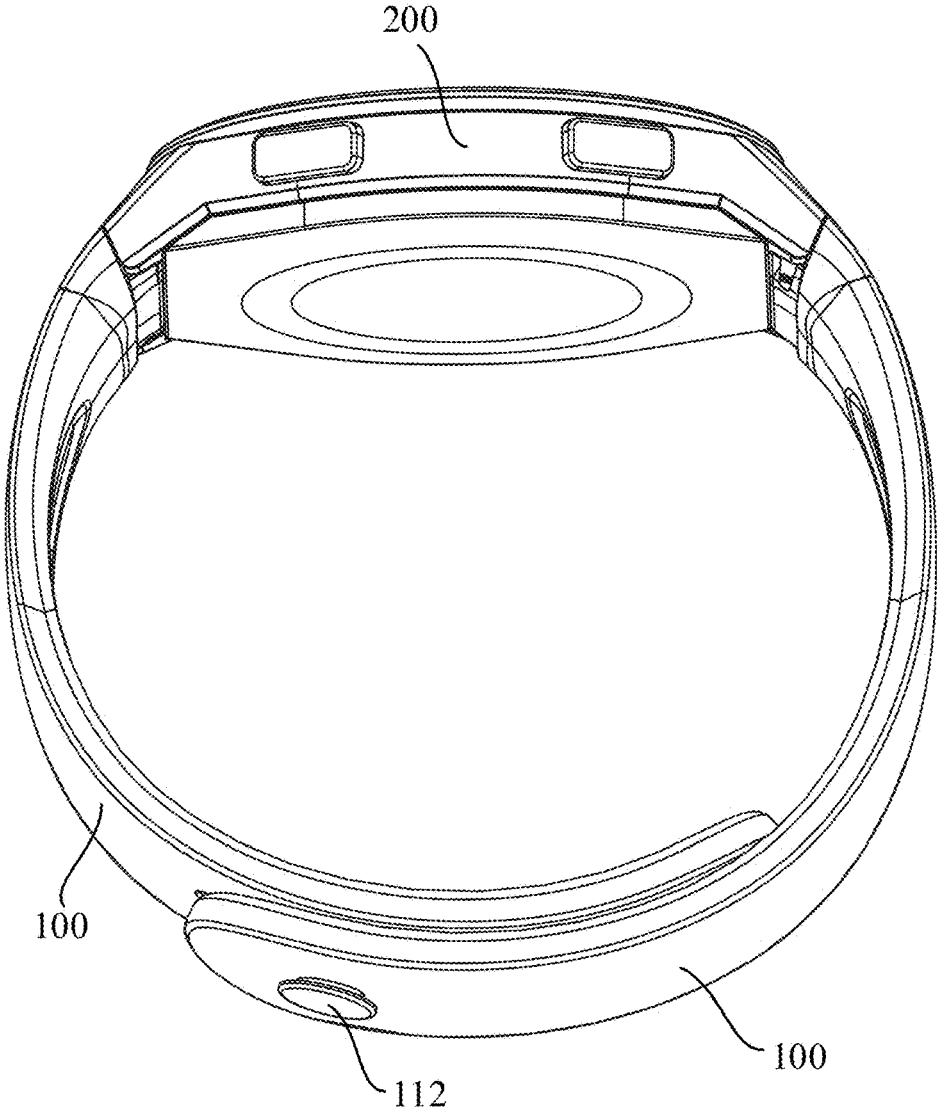
FIG. 9 is a schematic s structural view of a fourth embodiment of a wrist wearable device of the present application.
Figure 10:
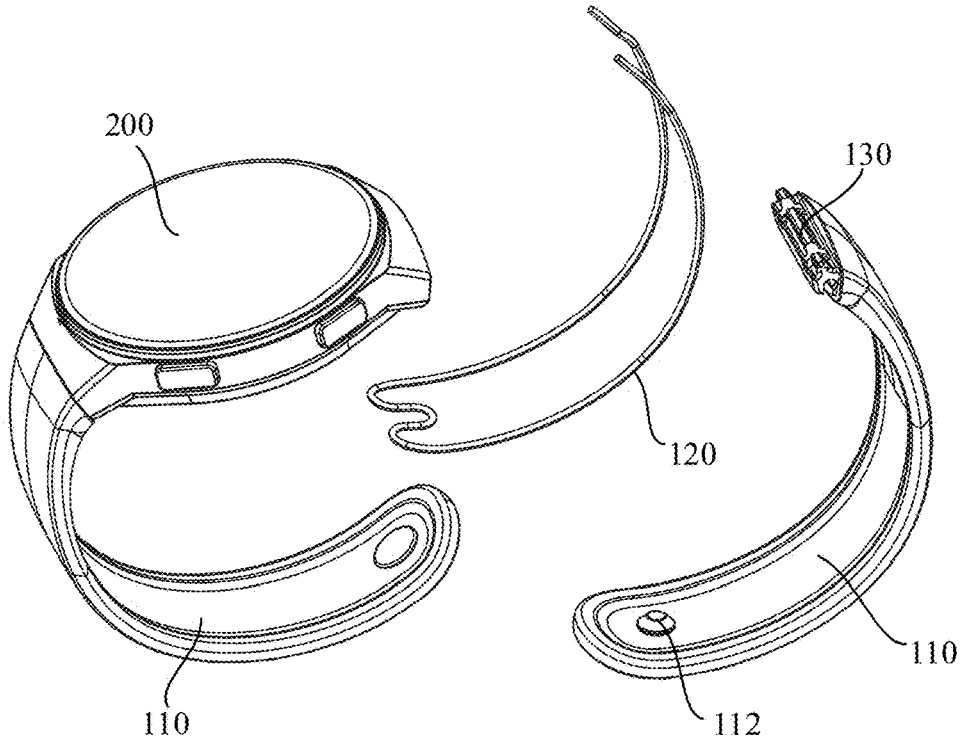
FIG. 10 is a schematic explosive view of the wrist wearable device shown in FIG. 9 from a perspective.
Figure 11:
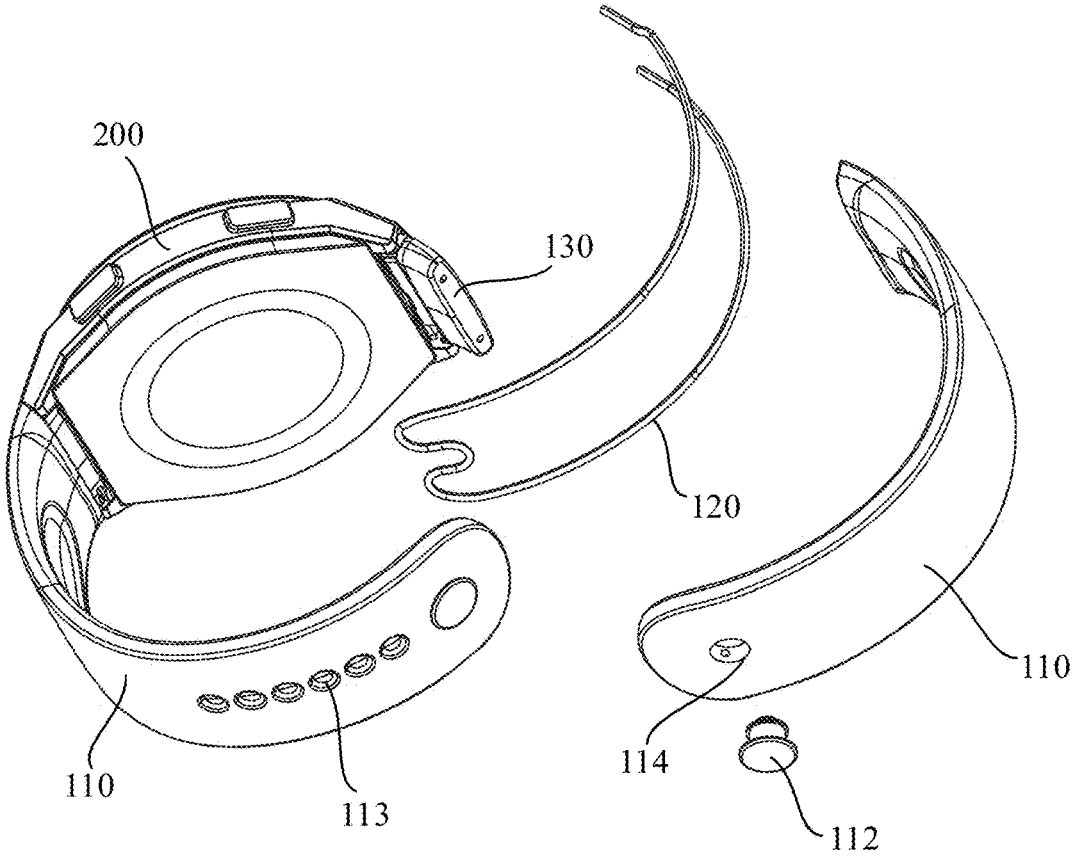
FIG. 11 is a schematic explosive view of the wrist wearable device shown in FIG. 9 from another perspective.

In an embodiment, referring to FIGS. 9 to 11, the memory metal portion 120 includes a strip-shaped memory metal piece 120*a* (generally embodied as a memory metal wire, or embodied as a memory metal narrow sheet), and the memory metal piece 120*a* includes a first metal segment 121, a second metal segment 122, and a third metal segment 123 that are sequentially connected, where the first metal segment 121 and the third metal segment 123 both extend along a length direction of the wristband body portion 110 and are arranged in parallel, and the second metal segment 122 is arranged at the free end of the wristband body portion 110, and the second metal segment 122 is provided with at least one bent portion 122*a*. However, the present disclosure is not limited hereto. In other embodiments, referring to the FIG. 13, there may also be multiple bent portions 122*a* arranged on the second metal segment 122. It should be understood that, in this embodiment, the memory metal piece 120*a* is substantially U-shaped (the bent portion 122*a* is only arranged at a closed end of the memory metal piece 120*a*), an open end of the memory metal piece 120*a* is configured to be fixedly connected to the connecting portion 130, and the closed end of the memory metal piece 120*a* is arranged at the free end of the wristband body portion 110. In this embodiment, the second metal segment 122 of the memory metal portion 120 provided with multiple bent portions 122*a* is arranged at the free end of the wristband body portion 110, and because the structural strength of the bent portion 122*a* is relatively high, the structural strength of the wristband body portion 110 can be enhanced, and the structural stability of the product can be improved.

Figure 12:
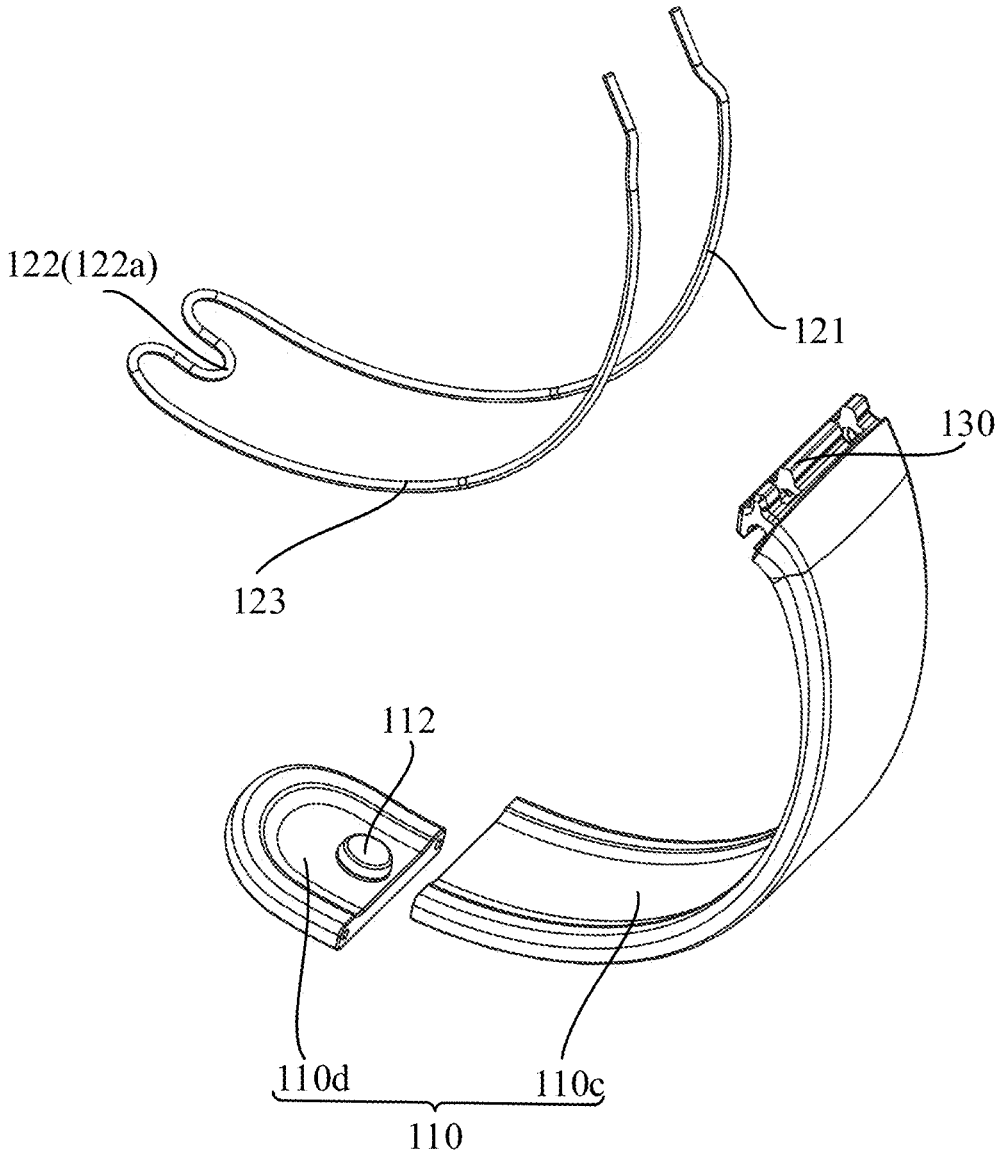
FIG. 12 is a schematic structural view of another embodiment of the wristband of the wrist wearable device of the present application.
Figure 13:
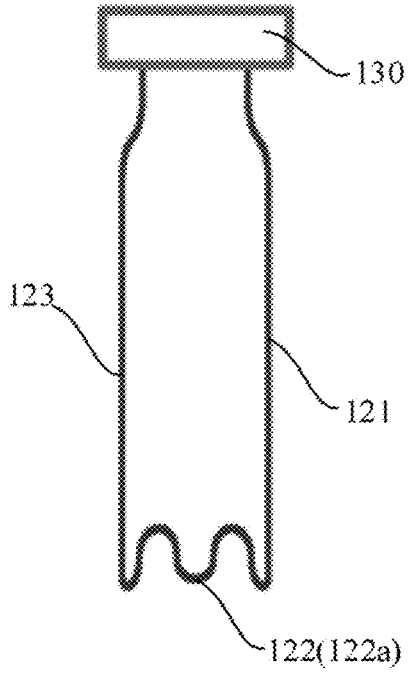
FIG. 13 is a schematic structural view of an embodiment of the memory metal portion of the wristband.

In an embodiment, referring to FIGS. 12 and 13, the end of the first metal segment 121 away from the second metal segment 122 and the end of the third metal segment 123 away from the second metal segment 122 are both connected to the connecting portion 130, and are arranged close to each other. In this way, it facilitates of increasing the minimum distance between the free end of the first metal segment 121 and a peripheral edge of the connecting portion 130, and increasing the minimum distance between the free end of the third metal segment 123 and the peripheral edge of the connecting portion 130, which facilitates of the wrapping to the free end of the first metal segment 121 and the free end of the third metal segment 123 by the connecting portion 130 (generally a hard plastic piece), thereby enhancing the structural strength. In addition, the free end of the first metal segment 121 and the free end of the third metal segment 123 are generally arranged close to each other by bending. In this way, the strength of the memory metal piece 120*a* can be enhanced. At the same time, the bending can further reduce the slippage of the memory metal piece 120*a* in the wristband body portion 110, which is beneficial to the stability of a whole structure of the wristband 100.

In an embodiment, referring to FIGS. 9 to 11, a mounting hole 114 located inside the bent portion 122*a* is arranged at the free end of at least one wristband body portion 110. It should be understood that the mounting hole 114 is located on the inner side of the bent portion 122*a*, so as to prevent the second metal segment 122 from being broken due to the arrangement of the mounting hole 114. In addition, the mounting hole 114 is arranged to provide mounting location for other accessories of the wristband 100. For example, but not limited to, in a case that there are two wristbands 100 and the free ends of the two wristband body portions 110 are overlapped with each other, a mounting hole 114 of at least one wristband body portion 110 is provided with a protruding piece 112, and the other wristband body portion 110 is provided with a concave hole 113 corresponding to the protruding piece 112, and the protruding piece 112 is at least partially inserted into the concave hole 113. It should be understood that a part of the protruding piece 112 extends into the mounting hole 114 to be connected and fixed with the mounting hole 114, and the other part of the protruding piece 112 protrudes from the outer surface of the wristband body portion 110, so as to be at least partially inserted in the concave hole 113 on the other wristband body portion 110, thereby limit the relative displacement between the two wristband body portions 110. In this embodiment, the embossment piece 112 and the concave hole 113 are generally in clearance fit, and there is no clinging or buckling situation. That is, when the device body 200 or the wristband body portion 110 is stretched, the two wristbands 100 can be easily opened, which can still facilitate of putting off the wrist wearable device. In addition, the cooperation between the protruding piece 112 and the concave hole 113 mainly enable increasing the frictional force between the two opposite surfaces of the two overlapped free ends, and reduce the probability of generating the displacement between the two overlapped free ends along the length direction of the wristband body portion 110, thereby improving the wearing stability of the wristband 100. In an embodiment, the concave hole 113 may be embodied as a blind hole. However, the present disclosure is not limited hereto, and in other embodiments, the concave hole 113 may also be embodied as a through hole. In a further embodiment, the wristband body portion 110 is provided with multiple concave holes 113 at intervals along an extension direction of the wristband body portion 110, so that the protruding piece 112 can still cooperate with the concave holes 113 when the overlapping lengths of the two free ends varies, and thus users with different wrist sizes can all experience the wearing stability caused by the cooperation between the protruding piece 112 and the concave holes 113.

However, the present disclosure is not limited hereto. In other embodiments, in a case that the wristband 100 has decorative nails, the decorative nails can be inserted and mounted in the mounting holes 114. Generally, the opposite ends of the decorative nails are flushed with the two opposite surfaces of the wristband body portion 110. Particularly, in a case that decorative nails are mounted in the mounting holes 114, in order to limit the relative displacement between the two wristband body portions 110, the above technical solution of arrangement of the embossments 111 can be adopted, that is, the embossments 111 (especially soft rubber embossments) are arranged on at least one of the two opposite surfaces of the two overlapped free ends.

It should be noted that, in general, the above two technical solutions for limiting the relative displacement between the two wristband body portions 110 (the technical solution in which the protruding piece 112 are cooperated with the concave holes 113 and the technical solution in which the embossments 111 are provided) are in the alternative, that is, it may either only provide the cooperation of the protruding piece 112 and the concave holes 113 or only provide the embossments 111 (especially soft rubber embossments).

In an embodiment, referring to FIG. 12, the wristband body portion includes a body segment 110*c* and a free segment 110*d* that are connected to each other, and the free segment 110*d* is formed as a free end of the wristband body portion 110. That is, the mounting hole 114 is provided in the free segment 110*d*. Regarding the memory metal 120, at least the second metal segment 122 protrudes from the body segment 110*c* and is connected to the free segment 110*d*. The free segment 110*d* is made of hard plastic material or other hard material. It should be understood that hard materials are not prone to deform, which facilitates the stable combination between the protruding piece 112 and the mounting holes 114, and reduces the probability of the protruding piece 112 being separated from the wristband body portion 110. In addition, in some other embodiments, the protruding piece 112 may also be made of hard plastic material or other hard materials, and be integrally formed with the free end. In an embodiment, the free segment 110*d* and the body segment 110*c* are integrally formed by injection molding, which is beneficial to mass manufacturing and can improve the production efficiency of the product. However, the present disclosure is not limited hereto. In other embodiments, the free segment 110*d* can also be buckled with and connected to the second metal segment 122. It should be noted that, in that case, the bent portion 122*a* on the second metal segment 122 corresponding to the mounting hole 114 is bent in a direction toward and approaching the body segment 110*c*, so that the protruding piece 112 at the mounting holes 114 can be clipped into the bent portion 122*a*.

Figure 14:
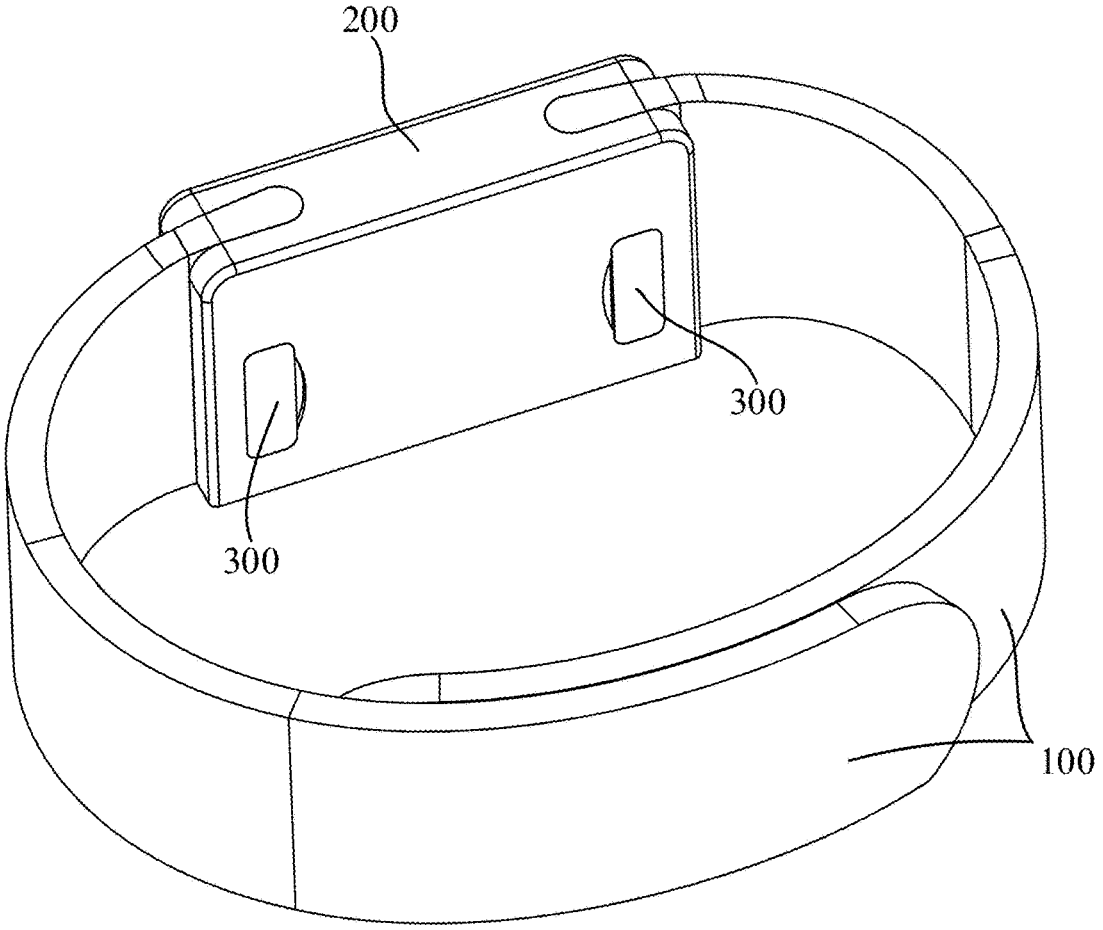
FIG. 14 is a schematic structural view of a fifth embodiment of the wrist wearable device of the present application.
Figure 15:
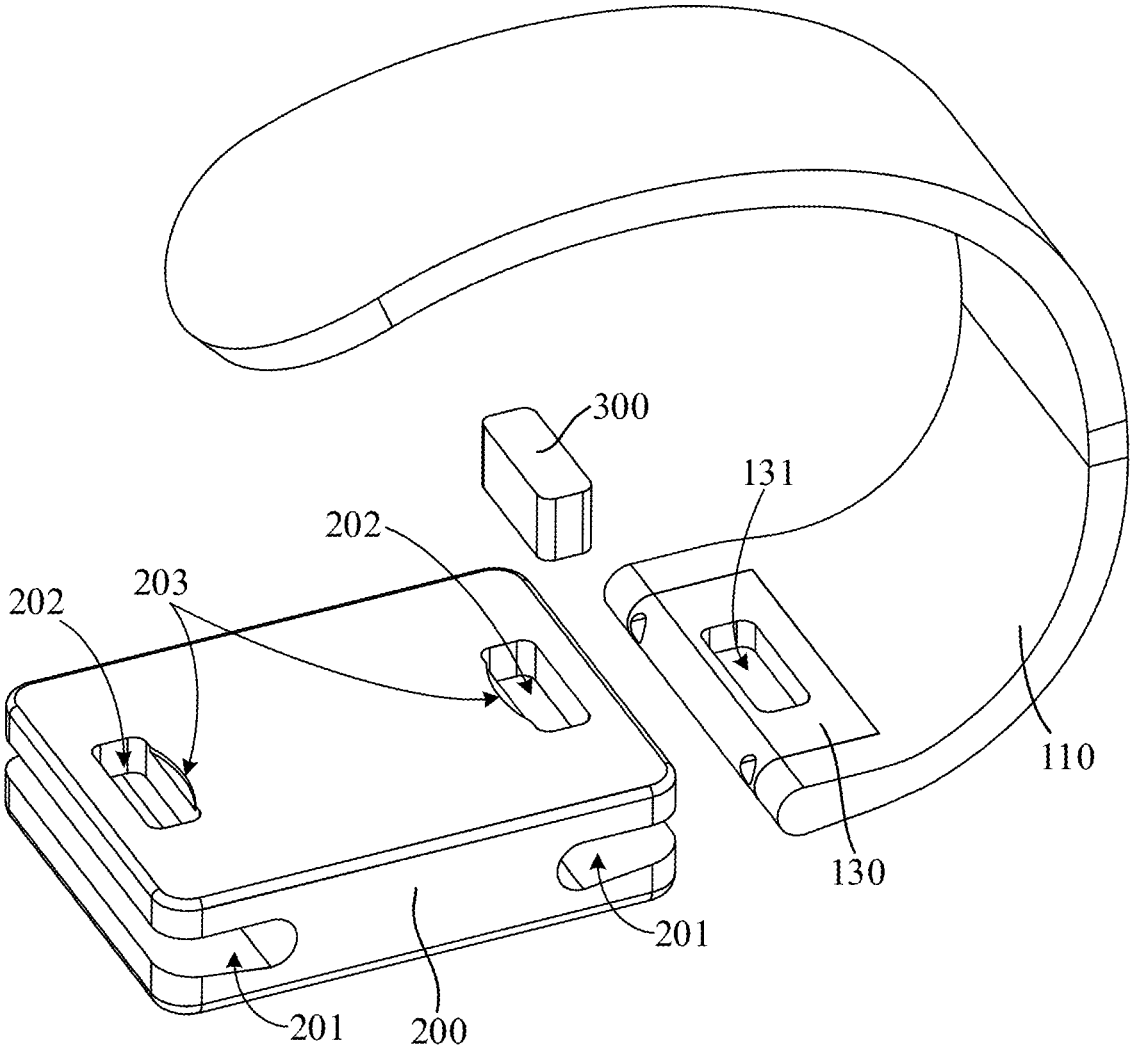
FIG. 15 is a schematic explosive view of a part of components of the wrist wearable device shown in FIG. 14.
Figure 16:
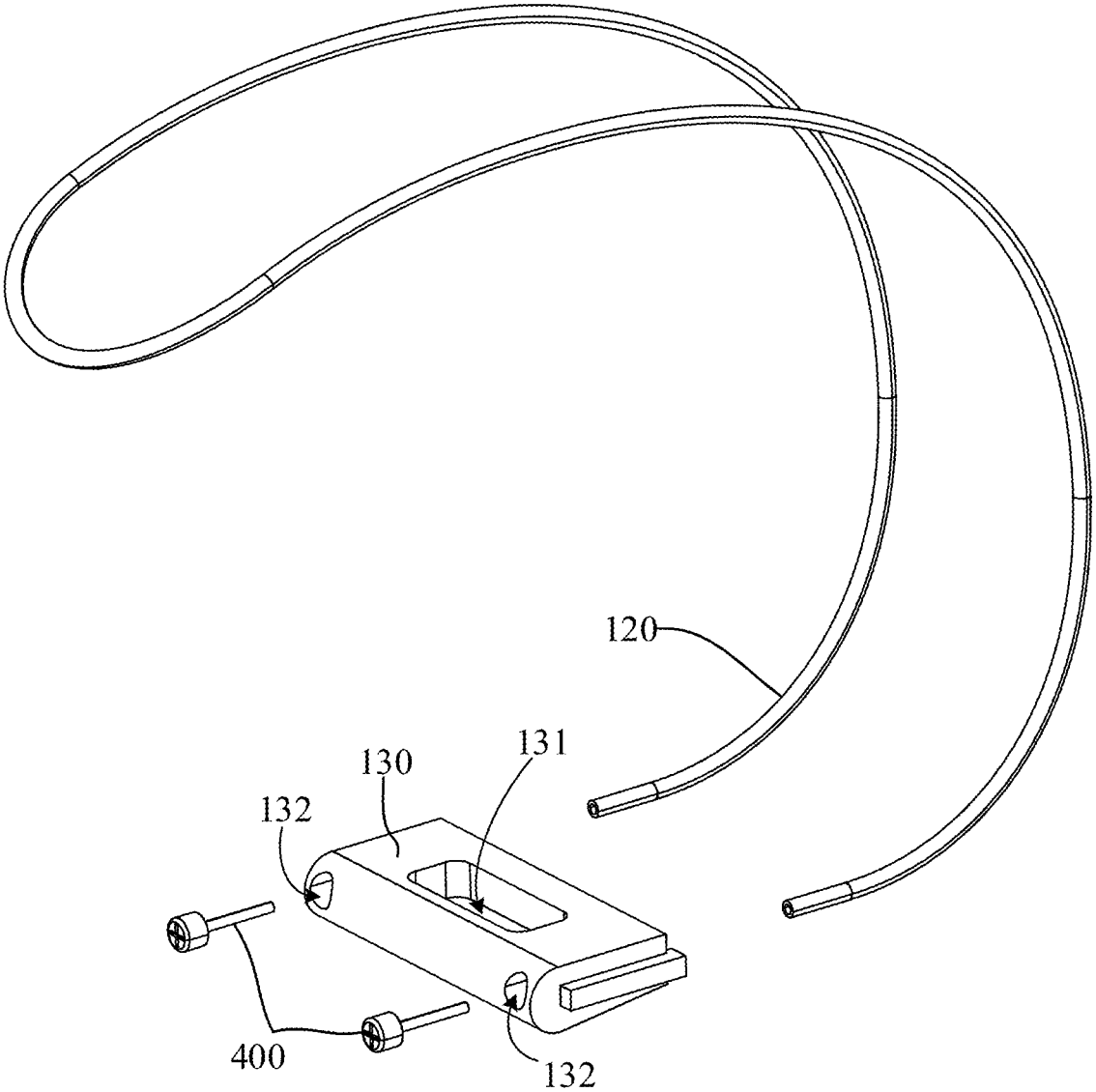
FIG. 16 is a schematic structural view of an embodiment between the memory metal portion and a connecting portion of the wristband.

In an embodiment, referring to FIGS. 14 to 16, a mounting slot 201 is arranged at an end of the device body 200, and a buckling hole 202 is arranged at the mounting slot 201. The connecting portion 130 of the wristband is connected to the mounting slot 201 in a pluggable manner, and a buckling groove 131 is arranged on the connecting portion 130. The wrist wearable device further includes a buckling block 300, after the connecting portion 130 is inserted into the mounting slot 201, the buckling groove 131 aligns with the buckling hole 202, the buckling block 300 penetrates through the buckling hole 202 and is buckled into the buckling groove 131, and the buckling block 300 is magnetically attracted to the connecting portion 130 to lock the wristband 100 inside the mounting slot 201. In this embodiment, when mounting the wristband 100, after the connecting portion 130 is inserted into the mounting slot 201, the wristband 100 is indirectly connected to the device body 200 via the connecting portion 130. When the connecting portion 130 is inserted to be in place, the buckling groove 131 on the connecting portion 130 is arranged to align with the buckling hole 202 of the device body 200. After that, the buckling block 300 is arranged inside the buckling groove 131 through the buckling hole 202, and the buckling block 300 can be buckled with the buckling groove 131 and magnetically attracted to the connecting portion 130, so that the wristband 100 can be locked, which enables the wristband 100 firmly connected to the device body 200. When detaching the wristband 100, the process is reversed to the above process. Specifically, the buckling block 300 is taken out from the buckling hole 202, and thus the wristband 100 can be unlocked, and the wristband 100 can be separated from the device body 200 by pulling out the connecting portion 130 from the mounting slot 201, so as to complete the detachment of the wristband 100.

However, the present disclosure is not limited hereto. In other embodiments, the connecting portion 130 and the device body 200 may also be connected by a spring bar. Specifically, an end of the device body 200 is provided with a connecting notch corresponding to the connecting portion 130, and each of two sides of the connecting notch is provided with a fixing groove. During assembly, the spring bar needs to be inserted into the connecting portion 130, two ends of spring bar are aligned with two fixing grooves, and a spring bar lever is pulled so as to make spring bar nails, which are located at two ends of the spring bar, be inserted into the two fixing grooves completely. The disassembly process is similar, and the spring bar lever must be pulled so as to make the spring bar nails at one side first out from one of the fixing grooves, and then take off the whole watchband.

In an embodiment, referring to FIG. 15, in the technical solution of using the buckling block 300 for connection and fixation, a side of the buckling hole 202 is provided with a relieving notch 203, which facilitates of taking out the buckling block 300. Of course, in other embodiments, it is also possible that a part of the buckling block 300 is exposed outside the buckling hole 202, which also facilitates of taking out the buckling block 300.

In an embodiment, at least one of the connecting portion 130 and the buckling block 300 is a magnet, at most one of the connecting portion 130 and the buckling block 300 is made of magnetic metal material. That is, in this embodiment, it may be the case that the buckling block 300 is a magnet and the connecting portion 130 is made of magnetic metal material, and it may also be the case that the connecting portion 130 is a magnet, and the buckling block 300 is made of magnetic metal material, and it may also be the case that the buckling block 300 and the connecting portion 130 are both magnets. In this case, when arranging magnetic poles of the buckling hole 202 and the connecting portion 130, it should be ensured that the buckling block 300 can be buckled with the buckling groove 131 while being magnetically attracted to the connecting portion 130. That is, the magnetic pole on a part of the buckling block 300, which is configured to be in contact with the buckling groove 131, should be opposite to the magnetic pole at the buckling groove 131 of the connecting portion 130. The above three arrangements can make the buckling block 300 magnetically attracted to the connecting portion 130, so that the buckling block 300 is stably buckled in the buckling groove 131 to ensure the wristband 100 of being locked.

Further, in this embodiment, the buckling block 300 is a magnet, and the connecting portion 130 includes a magnetic metal sheet or a magnetic sheet arranged in the buckling groove 131. In this way, when the buckling block 300 is buckled with the buckling groove 131, the buckling block 300 will be magnetically attracted to the magnetic metal sheet or magnetic sheet to limit the position of the connecting portion 130, so that the wristband 100 is locked. Particularly, in order to ensure that the magnet and the magnetic sheet are magnetically attracted, it is necessary to take a magnetic pole of the magnetic sheet, a position of the magnetic sheet in the buckling groove 131, a mounting angle of the magnetic sheet, and a magnetic pole of the buckling block 300 into consideration comprehensively so as to ensure that the magnetic pole on a part of the buckling block 300, which is configured to be in contact with the magnetic sheet, should be opposite to the magnetic pole of the connecting portion 130. Of course, in other embodiments, it is also possible that the buckling block 300 is a magnetic metal block, and the connecting portion 130 includes a magnetic sheet arranged in the buckling groove 131.

According to the above description of the disclosed embodiments, features described in the embodiments of the present application may be replaced or combined with each other, so that those skilled in the art may implement or practice the present application. The above description is merely a preferred embodiment of the present application and does not limit the present application in any form. Preferred embodiments of the present application are disclosed above, and are not intended to limit the present application. Numerous alternations, modifications and equivalents can be made to the technical solutions of the present application by those skilled in the art in light of the methods and technical contents disclosed herein without departing from the scope of the present application. Therefore, any simple changes, equivalent variations and modifications on the above embodiments made according to the technical essence of the present application without departing the content of the technical solutions of the present application fall within the scope of protection of the technical solutions of the present application.

The invention claimed is:

1. A wristband, comprising:

two wristband body portions, one end of each of the two wristband body portions connects to one end of a device body of a wrist wearable device, and another end of each of the two wristband body portions is a free end; and a memory metal portion, which is arranged on each of the two wristband body portions and has an arc-shaped memory state in a natural state, so that each of the two wristband body portions is naturally maintained in an arc shape, and the wristband is naturally maintained in a wearing state;

an arc of each of the two wristband body portions subtends an angle of less than 180 degrees; and the free ends of the two wristband body portions are overlapped with each other, at least one of two contacting opposite surfaces of the two overlapped free ends is provided with flexible embossments.

2. A wrist wearable device, comprising a device body and the wristband according to claim 1.

3. The wrist wearable device according to claim 2, wherein a mounting slot is arranged at an end of the device body, and a buckling hole is arranged at the mounting slot; a connecting portion of the wristband is connected to the mounting slot in a pluggable manner, and a buckling groove is arranged on the connecting portion;

the wrist wearable device further comprises a buckling block; after the connecting portion is inserted into the mounting slot, the buckling groove aligns with the buckling hole, the buckling block penetrates through the buckling hole and is buckled to the buckling groove, and the buckling block is magnetically attracted to the connecting portion to lock the wristband in the mounting slot.

4. The wrist wearable device according to claim 3, wherein at least one of the connecting portion and the buckling block is a magnet.

5. A wristband, comprising:

a wristband body portion, one end of the wristband body portion is configured to connect to one end of a device body of a wrist wearable device, and another end of the wristband body portion is a free end;

a memory metal portion, which is arranged on the wristband body portion and has an arc-shaped memory state in a natural state, so that the wristband body portion is naturally maintained in an arc shape, and the wristband is naturally maintained in a wearing state; and a connecting portion configured to be connected with one end of the device body of the wrist wearable device, wherein the memory metal portion comprises a strip-shaped memory metal piece, and the memory metal piece comprises a first metal segment, a second metal segment, and a third metal segment that are sequentially connected, the first metal segment and the third metal segment both extend along a length direction of the wristband body portion and are arranged in parallel, the second metal segment is arranged at the free end of the wristband body portion, and the second metal segment is provided with at least one bent portion; and a mounting hole located inside the at least one bent portion is arranged at a free end of the wristband body portion.

* * * * *